US009067658B2

(12) United States Patent
Hughes

(10) Patent No.: US 9,067,658 B2
(45) Date of Patent: Jun. 30, 2015

(54) INFLATABLE SWIM VEST

(71) Applicant: Hugh Patrick Hughes, Elm Grove, WI (US)

(72) Inventor: Hugh Patrick Hughes, Elm Grove, WI (US)

( * ) Notice: Subject to any disclaimer, the term of this patent is extended or adjusted under 35 U.S.C. 154(b) by 0 days.

(21) Appl. No.: 14/167,586

(22) Filed: Jan. 29, 2014

(65) Prior Publication Data

US 2014/0213128 A1 Jul. 31, 2014

Related U.S. Application Data

(60) Provisional application No. 61/759,206, filed on Jan. 31, 2013.

(51) Int. Cl.
*B63C 9/15* (2006.01)
*B63C 9/125* (2006.01)

(52) U.S. Cl.
CPC ..... *B63C 9/1255* (2013.01)

(58) Field of Classification Search
CPC ..... B63C 9/00; B63C 9/11; B63C 9/125; B63C 9/1255; B63C 9/13; B63C 9/15; B63C 9/155; B63C 9/18
USPC ..... 441/80, 88, 90, 92–94, 96, 106, 108, 441/111–119, 122, 123
See application file for complete search history.

(56) References Cited

U.S. PATENT DOCUMENTS

| | | | | |
|---|---|---|---|---|
| 5,338,239 | A * | 8/1994 | Cleaveland | 441/106 |
| 5,603,648 | A * | 2/1997 | Kea | 441/106 |
| 5,759,076 | A * | 6/1998 | Bateman et al. | 441/115 |
| 5,839,933 | A | 11/1998 | Davis, Sr. et al. | |
| 6,976,894 | B1 | 12/2005 | Turner | |
| 7,047,966 | B2 | 5/2006 | Stewart | |
| 7,351,126 | B2 | 4/2008 | Turner | |
| 7,699,679 | B2 | 4/2010 | Lahyani | |
| 7,704,113 | B2 | 4/2010 | Pele et al. | |
| 8,231,421 | B1 | 7/2012 | Hubbard et al. | |

* cited by examiner

*Primary Examiner* — Daniel V Venne
(74) *Attorney, Agent, or Firm* — Andrus Intellectual Property law, LLP

(57) ABSTRACT

An inflatable swim vest is constructed with a first layer and a second layer having respective outer edges variously secured together by a temporary closure to define a compartment therebetween. An inflatable bladder arrangement includes an inflatable bladder stored and housed in a deflated condition in separate areas of the compartment. The inflatable bladder arrangement further includes an inflator mechanism operatively connected to a charged gas canister and to the inflatable bladder. The fixtures securing the outer edges of the first and second layers include a temporary closure configured for temporarily affixing the outer edges together and to be easily separable such that upon actuation of the inflator mechanism, gas is delivered to the inflatable bladder. This results in an inflated condition of the bladder, and produces a force that will open the temporary closure and enable expansion of the bladder out of the compartment of the vest.

20 Claims, 10 Drawing Sheets

10
14
14
U
124
56
56
48
126
48
52
98
52
22
12
20
20
36

10
14
14
U
56
56
78
22
Y
18
48
52
48
74
74
20
36
36
76
76

88
112
24
106
102
78
56
20
18
20
74
74
36
36
76
76

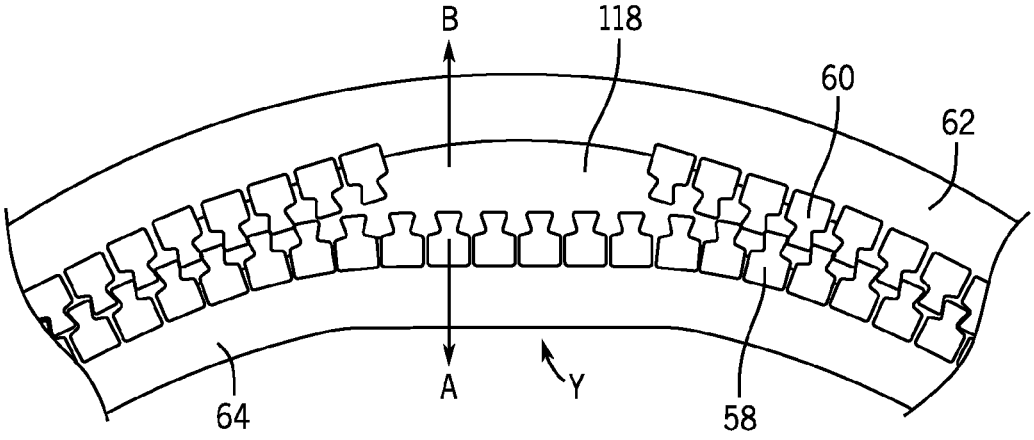
FIG. 12
FIG. 13
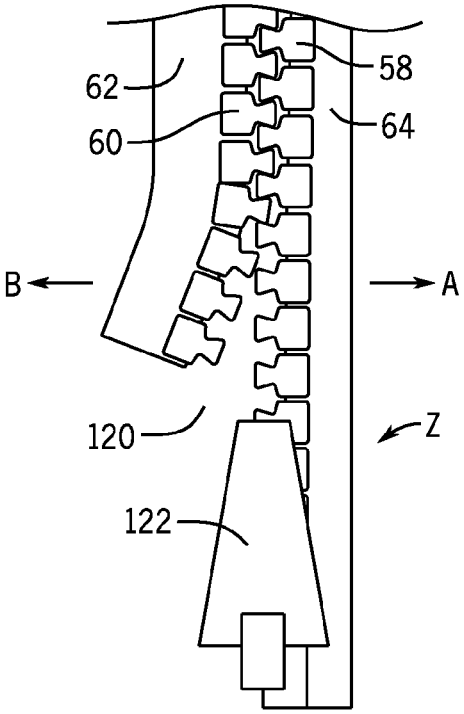
FIG. 11
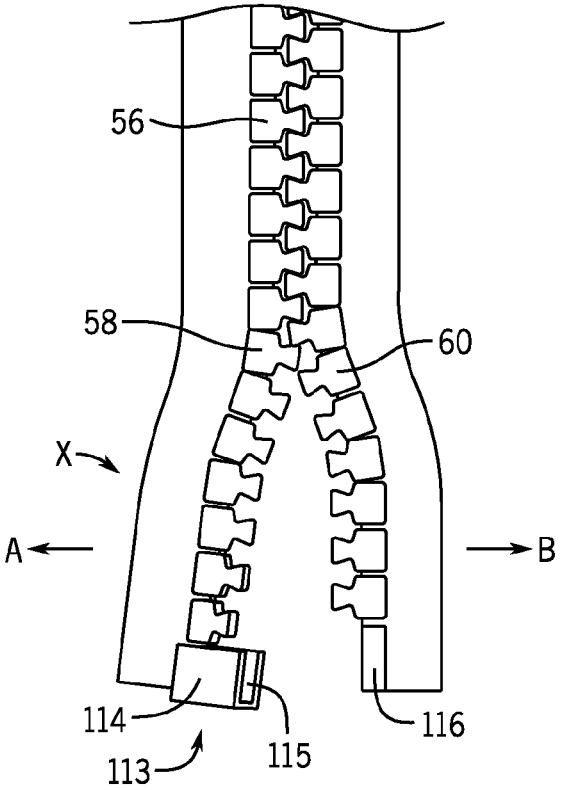

INFLATABLE SWIM VEST

CROSS-REFERENCE TO RELATED APPLICATION

This application relates to and claims priority to and the benefit of U.S. Provisional Patent Application Ser. No. 61/759,206 filed Jan. 31, 2013, the disclosure of which is hereby incorporated herein by reference.

BACKGROUND OF THE INVENTION

The present disclosure relates generally to personal flotation devices, and more particularly, pertains to an inflatable swim vest which is designed to be worn while swimming or doing water activities where swimming is a component, and can provide emergency flotation when desired to keep a user's head above the surface of the water. Triathletes, lone swimmers and others drown every year because there is no flotation vest designed to be comfortably worn, unrestrictive enough to allow for proficient movement while swimming and provides no buoyancy while swimming unless the riser finds him or herself in an emergency in which case the vest is deployed and can function as an effective life saving device by providing immediate buoyancy and floating the user to safety.

Personal flotation devices are commonly used and or required in water activities where individuals wish to float on top of the water. The safety provided by these devices is enjoyed by many users. Unfortunately, two characteristics of inherently buoyant life vests or life jackets prevent users from wearing them all the time when performing water activities: their bulk and their inherent buoyancy. The inherent buoyancy of these jackets makes swimming cumbersome, makes them illegal in triathlons and is unnecessary when performing activities like stand-up paddle boarding, or surfing except in cases of emergency. The majority of inherently buoyant life vests are also bulky, making them uncomfortable when performing activities like canoeing, kayaking and fishing which leads to a lack of use or compliance and an increased chance of accidental drowning in these activities.

In order to alleviate these two problems of bulk and inherent buoyance, individuals have begun to incorporate inflatable bladders into water sports to provide users with the instantaneous flotation they may need in case of emergency. Several proposals have been made to combine a wetsuit with inflation capabilities as evidenced by U.S. Pat. Nos. 6,976,894, 7,351,126, 7,699,679 and 8,231,421.

Unfortunately there are many applications where a simple sleek vest would be desirable rather than a wetsuit or any variations thereof Users often do not want to wear a wetsuit or variations thereof on hot days or when performing certain activities, but they Still need the security of emergency buoyancy. One example of an application where an inflatable vest is superior to inflatable wetsuits is in triathlon events where rules limit the designs and types of wetsuits that can be worn. Unfortunately, most inflatable wetsuits would not be permitted in a triathlon event and therefore participants still run the risk of drowning every time they compete. Such devices need to be designed with the rules of triathlons in mind to mitigate this danger by providing a minimalist emergency flotation vest constructed of triathlon legal materials that can be worn over participants' legal wetsuits without slowing them down or inhibiting their swimming strokes. Other proposals have incorporated bladders into vests intended to be used onshore or in boats, but not designed to be form fitting, capable of functioning in water and able to be worn while swimming aggressively in activities like triathlon races, surfing and snorkeling. These proposals are evidenced by U.S. Pat. Nos. 5,839,933, 5,746,633, 7,047,966, and 7,704,113. These vests are not designed to contour to the body and to be worn while performing activities like swimming in water and as such do not address the need previously described.

As such, a need remains for an inflatable personal flotation device that is designed to be simply slipped over a user's head and shoulders and secured with straps, and that is form fitting enough to be worn without limiting a user's ability to swim normally. The device needs to fit the contours of many different user body types and not create unnecessary drag in the water while still being able to provide emergency flotation immediately when deployed.

SUMMARY OF THE INVENTION

The present disclosure relates to an inflatable personal flotation device that includes a vest having, at least a front portion connected to a back portion. The front and back portions are adapted to be secured around the torso of a user. The vest is constructed with a first layer and a second layer having respective outer edges secured together by a temporary closure to define a compartment between the first layer and the second layer. An inflatable bladder arrangement includes an inflatable bladder stored and housed in a deflated condition in the compartment formed between the first layer and the second layer. The inflatable bladder arrangement further includes an inflator mechanism operatively connected to a charged gas canister and to the inflatable bladder. The temporary closure securing the outer edges of the first layer and the second layer together to form the compartment for housing the inflatable bladder therein is configured for temporarily affixing the outer edges together and to be easily separable such that upon actuation of the inflatable mechanism, gas is delivered to the inflatable bladder resulting in an inflated condition of the bladder and producing a force that will open the temporary closure, and enable expansion of the bladder out of the compartment in the front and back portions of the vest.

In an exemplary embodiment, the vest further includes shoulder portions connecting the front and back portions, and an open neck portion located between the front, back and shoulder portions. The temporary closure is preferably embodied by a bursting zipper with a plurality of weakened points that allow the zipper to open when the bladder is inflated. The vest includes a strap arrangement connected to at least one of the front and back portions. The inflatable bladder arrangement includes an adjustment valve for enabling deflation and oral inflation of the bladder in the inflated condition. The inflation mechanism is connected to the bladder by a manifold that extends through a mounting plate which is located in the compartment and connected in the back portion of the vest. The location of the inflation mechanism and the gas canister on the center of the user's back creates a streamlined design allowing for a comfortable fit when swimming, that other inflatable life vests don't provide due to the locations of their inflation mechanisms and gas canisters. The mounting plate allows for the location of the inflation mechanism and gas canisters on the center of the user's back and serves to securely affix the inflation mechanism to the back portion of the vest. The mourning plate further ensures that when a user pulls the ripcord, the inflator mechanism does not move around but rather stays in one place and directs the force of the ripcord directly through the hole of the mounting plate and always in the optimum direction for the triggering of the actuating lever on the inflation mechanism and guaranteeing immediate deployment of the vest. The inflatable bladder is attached to an upper end of the back portion, and has chest portions which are attached to a lower end of the front portion. A rip cord has one end attached to the actuator arm of the inflation mechanism, and another end which is provided with a handle and extends through an opening formed in the front portion so as to be readily accessible to the user.

The present disclosure further relates to an inflatable personal flotation device including a vest having a front portion, a back portion, shoulder portions connected to the front and back portions and an open neck portion located between the front, back and shoulder portions. The vest is constructed with a first layer adapted to rest against a user's skin, and a second layer facing, outwardly from the first layer. The first layer and the second layer have respective outer edges secured together by a temporary closure to define a compartment between the first layer and the second layer. The vest is provided with a strap arrangement connected to at least one of the front and back portions, and is adapted to be secured around a user's torso. An inflatable bladder arrangement includes an inflatable bladder formed with a pair of chest sections connected together by a looped neck section. The inflatable bladder is stored and housed in a folded and deflated condition in a single compartment formed between the first and second layers. The compartment is divided in the front by stitching down the middle of the front portion which directs the pressure of inflation outwards to the zipper and allows for a swift deployment and exit of the bladder from the compartment. The inflatable bladder arrangement further includes an inflator mechanism operatively connected to a charged gas canister and to the inflatable bladder by a manifold, and located in the compartment in the back portion of the vest. An adjustment valve is connected to the inflatable bladder and is positioned in the compartment in the front portion of the vest allowing the user to orally inflate the vest or deflate the vest, for re-use after deployment. The temporary closure securing the outer edges of the first layer and the second layer together to form the compartment for housing the inflatable bladder therein is a bursting zipper with a plurality of weakened points configured for temporarily affixing the outer edges together and to be easily separable such that upon actuation of the inflation mechanism, gas is delivered to the inflatable bladder from the gas canister. This results in an inflated condition of the bladder and produces a force that will open the temporary closure and enable expansion of the bladder out of the compartment formed in the front and back portions of the vest.

The first layer and the second layer are permanently affixed at the collar using stitching or other permanent means of attachment. The temporary closure that connects the first and second layer at the outer edge is preferably embodied in a bursting zipper design with a plurality of weakened, burst points that allow the bladder to exit the compartment formed between the first and second layer when inflating; the zipper temporarily connects the outer edges of the first and second layers and runs continuously along the front portion, the shoulder portions and the back portion. The outer edges of the first layer and the second layer in the front portion are inwardly curved as the outer edges extend between the shoulder portions and the strap arrangement. The second layer is formed as a flap portion in the back portion of the vest. The temporary closure extends along an entire surface of the front portion and extends along a partial surface of the back portion. A rip cord has one end attached to the inflator mechanism, and another end which is provided with a handle and extends through an opening formed in the from portion. The first and second layers are constructed of water friendly fabrics such as neoprene and or nylon.

BRIEF DESCRIPTION OF THE DRAWINGS

The drawings illustrate the best mode presently contemplated in carrying out the disclosure. In the drawings:

FIG. 11 depicts the proximal end of the zipper with open-sided box on the end of the zipper;

FIG. 12 depicts the weak point at the midpoint of the zipper; and

FIG. 13 depicts the distal end of the zipper where one side of the zipper is longer than the other allowing the zipper to separate.

DETAILED DESCRIPTION

Figure 1:
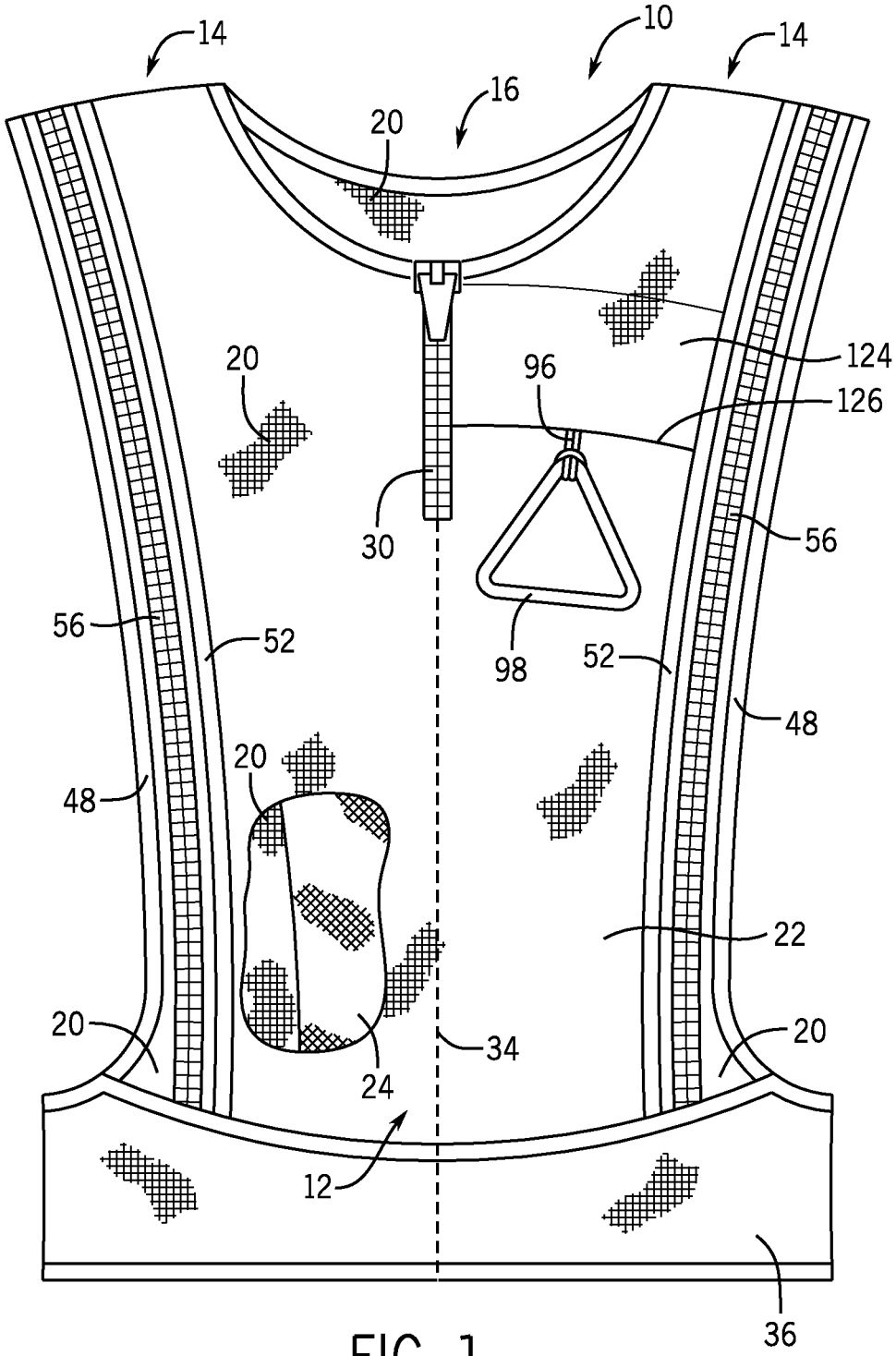
FIG. 1 is a front view of an inflatable swim vest in accordance with the present disclosure.
Figure 2:
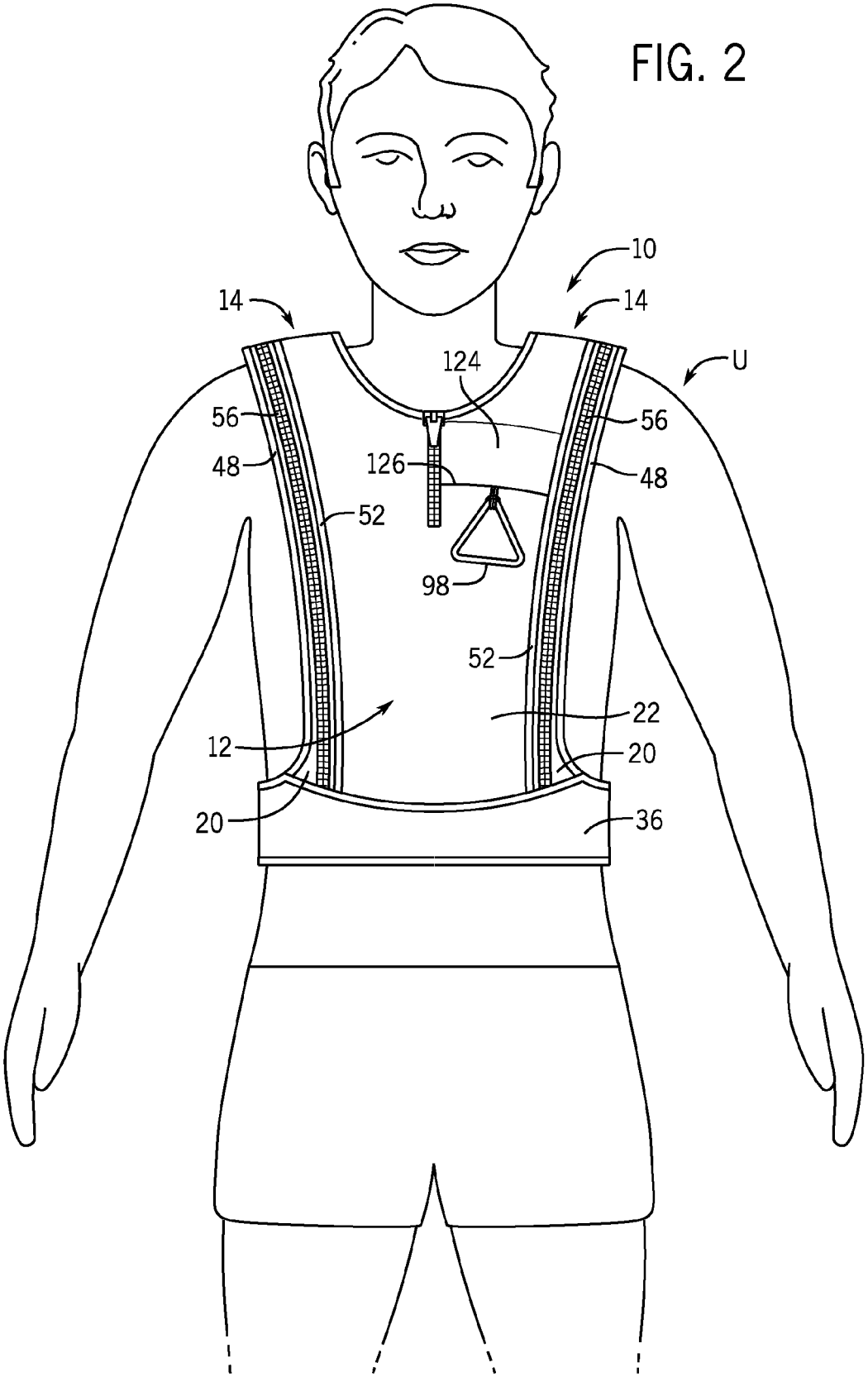
FIG. 2 is a front view of the inflatable swim vest of FIG. 1 as worn by a user.
Figure 3:
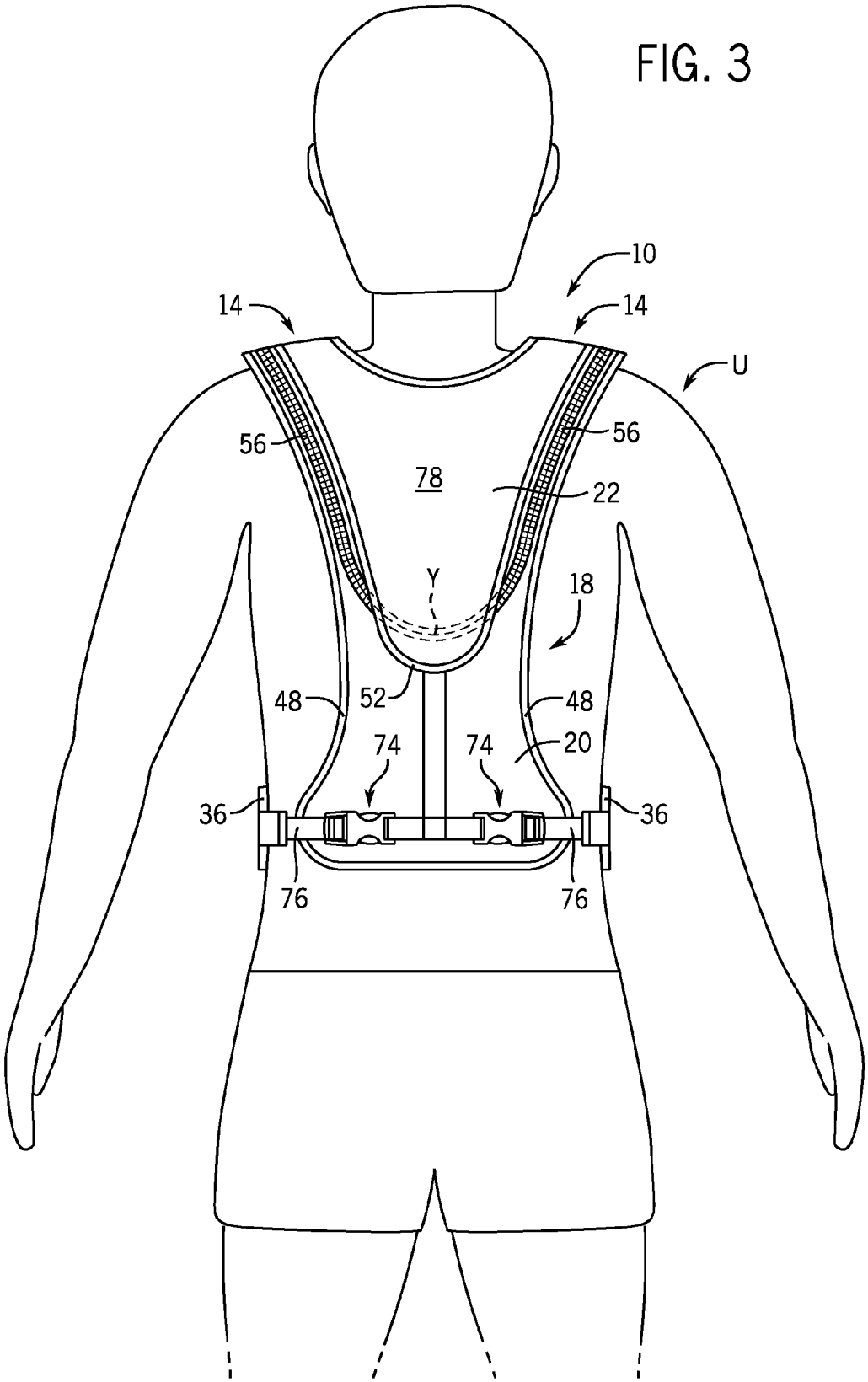
FIG. 3 is a rear view of FIG. 2.

The present disclosure will now be described more fully hereafter with a reference to the accompanying drawings in which a preferred embodiment is shown. The present disclosure however may be embodied in many different forms, and should not be construed as limited to the embodiments set forth herein. Rather, the exemplary embodiment is provided so that this disclosure will be thorough and complete to those skilled in the art. In the description to follow, like numbers refer to like elements throughout the Figures.

Referring to the drawings, the present disclosure relates to a personal flotation device shown preferably in the form of an inflatable swim vest 10 intended to be worn over the head of a user U and secured under the arms and around the torso thereof. The swim vest 10 is designed with minimal inherent buoyancy and is form fitted to minimize bulk so that it can be worn while performing the act of swimming, and can provide emergency flotation when desired or necessary.

FIGS. 1-9 illustrate various views of the swim vest 10 in uninflated and inflated conditions. The swim vest 10 is a layered, contoured apparel construction which is comprised of a front bib-like portion 12, shoulder portions 14, a cutout neck portion 16 and a back bib-like portion 18. The swim vest 10 includes two layers of material namely a first layer 20 designed to rest against the user's skin, and a second layer 22 configured to face outwardly relative to the user's skin. In the exemplary embodiment, the first layer 20 is typically formed of neoprene or nylon, and the second layer is constructed of neoprene or nylon, but it should be understood that other suitable materials may be used as desired. As will be described in more detail below, the first layer 20 and the second layer 22 are configured to be variously held together to create a compartment which is normally closed for storing an inflatable bladder 24 therein between the layers 20, 22.

Figure 4:
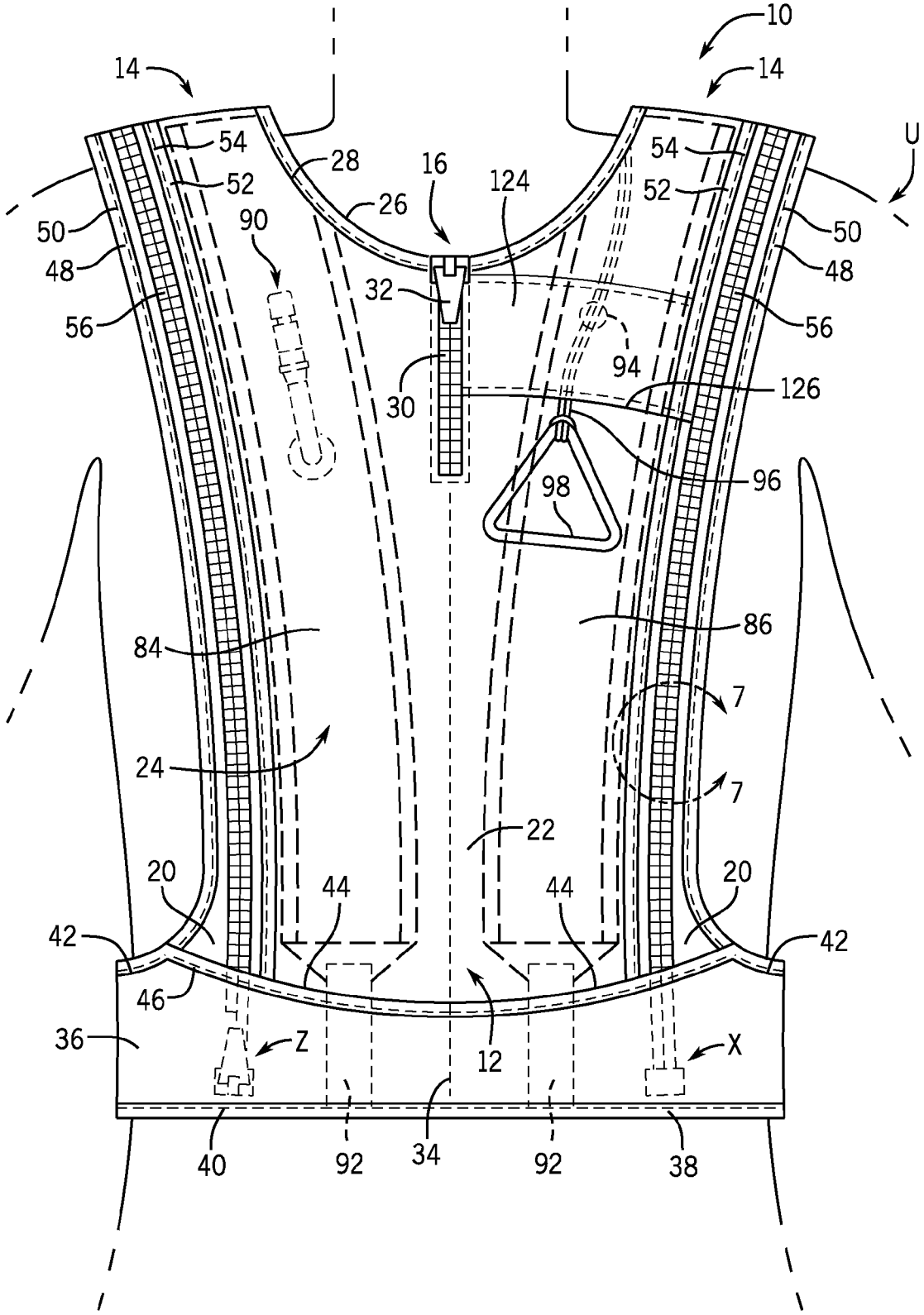
FIG. 4 is an enlarged front view of the swim vest of FIG. 2 showing an inflatable bladder, an adjustment valve and a rip cord incorporated within the swim vest.

As seen from the front portion 12 of the vest 10 depicted in FIG. 4, the first layer 20 and the second layer 22 are permanently affixed together along an inner edge 26 of the neck portion 16 such as by stitching 28 or other suitable means of permanent attachment. The first layer 20 and the second layer 22 are further permanently secured together to cooperating tape portions of a closure device, such as a zipper 30, extending downwardly from the inner edge 26, such as by stitching 32. In addition, the first layer 20 and the second layer 22 are permanently attached along a line extending centrally and medially on the front portion 12, such as by stitching 34. A central portion of a frontal strip 36 is permanently joined to the first layer 20 and the second layer 22 by a lower portion of the stitching 34. The frontal strip 36 is also permanently fixed to a lower edge 38 of the first layer 20, such as by stitching 40, and the lower ends of the first layer 20, such as by stitching 42. An upper edge 44 of the frontal strip 36 may be reinforced by stitching 46, but is not fixed to either of the layers 20, 22 except by stitching 34 so as to provide open access to a lower end of the second layer 22. The frontal strip 36 serves to cover the bottom right and left ends of the second layer 22 connected to the proximal and distal ends of the bursting. zipper 56 so as to prevent accidental opening of the zipper by snagging or opposite force. The frontal strip 36 ensures that the bursting zipper 56 only separates when the bladder is inflated.

Figure 7:
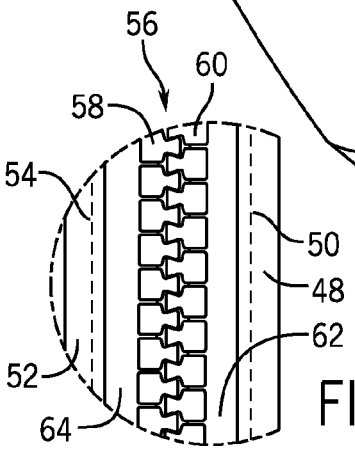
FIG. 7 is an enlarged detail view taken on line 7-7 of FIG. 4 showing a temporary closure for the swim vest, in the form of a bursting zipper.

With further reference to FIG. 4, the first layer 20 has an outer edge 48 with stitching 50 which runs continuously around the periphery extending, along the front portion 12, the shoulder portions 14 and the back portion 18 of the vest 10. The second layer 22 has an outer edge 52 with stitching 54 that also extends continuously along the front portion 12, the shoulder portions 14 and the back portion 18. Respective outer edges 48, 52 of the first layer 20 and the second layer 22 are temporarily affixed together by means of a temporary closure, such as an easily separable or "bursting" zipper 56 having interlocking zipper sides 58, 60 with weakened burst points where interlocking elements are not engaged and don't interlock, as discussed in greater detail below. As best seen in FIG. 7, the bursting zipper 56 has a first tape portion 62 secured by stitching 50 to the outer edge 48 of the first layer 20, and a second tape portion 64 connected by stitching 54 to the outer edge 52 the second layer 22, it should be understood that the temporary closure is not limited to the bursting zipper 56, but may be embodied in other suitable temporary attachments such as by snaps, hook-and-loop fasteners and the like.

Figure 5:
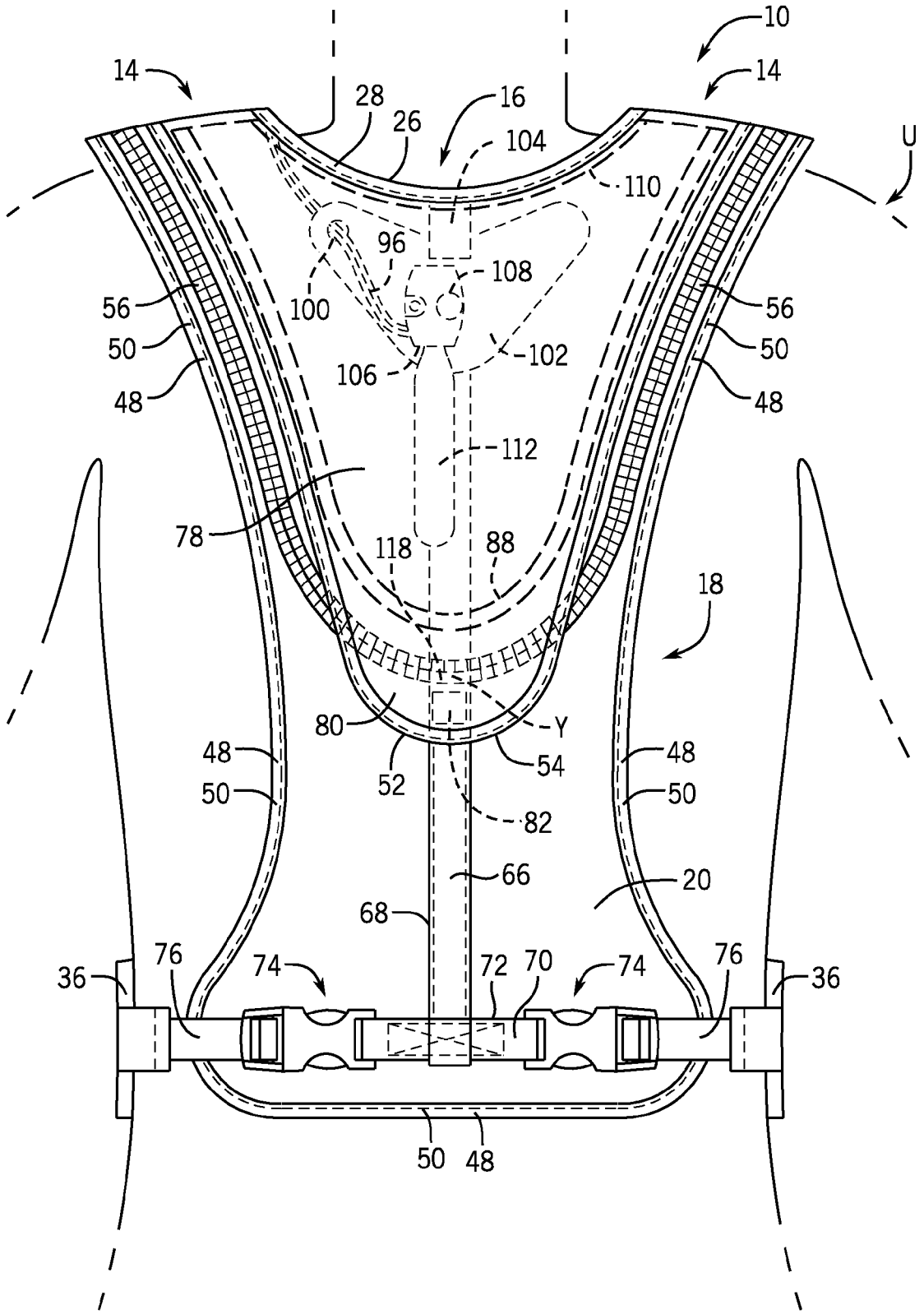
FIG. 5 is an enlarged rear view of the swim vest of FIG. 3 showing an inflator arrangement and the rip cord in dotted lines incorporated within the swim vest.

As seen from the back portion 18 of the vest 10 depicted in FIG. 5, a vertically extending reinforcing band 66 is permanently attached such as by stitching 68 to the first layer 20. The band 66 extends from the inner edge 26 of the neck portion 16 downwardly to a horizontally extending reinforcing band 70 permanently attached, such by stitching 72, to a lower end of the first layer 20. Opposite ends of the band 70 are attached to temporary fixtures such as releasable buckle assembly 74 that are secured by an adjustable strap 76 to opposite ends of the frontal strip 36. The frontal strip 36, the hand 70, the buckle assembly 74 and the strap 76 define a strap arrangement which enables the User to secure the vest 10 with a desired fit around the torso. It should be understood that the strap arrangement may alternatively he provided with the buckle assembly 74 in the front portion 12, rather than the back portion 18 or on the users sides between the front portion 12 and the back portion 18.

As further seen from the back portion 18 in FIG. 5, the bursting zipper 56 extends partially down the first layer 20 and traverses a flaring U-shaped path therealong. The second layer 22 which is temporarily affixed to an upper portion of the first layer 20 is formed as a flap portion 78. The flap portion 78 has a lower end 80 that is removably attached below the bursting zipper 56 to the band 66 of the first layer 20, and normally covers the lower segment of the zipper 56. In the example shown, the lower end 80 is removably attached by using a temporary closure, such as a hook-and-loop arrangement, a portion of which is shown at 82. The attachment between the lower end 80 of the flap portion 78 and the band 66 of the first layer 20 is generally aligned with the weakened portion Y of the bursting zipper 56 to prevent inadvertent separation of the bursting zipper 56, other than due to inflation of the bladder.

The first layer 20 and the second layer 22 define a compartment in the front portion 12 and the hack portion 18 for holding the inflatable bladder 24 in an uninflated and folded condition. The inflatable bladder 24 may be created using different materials and methods, but typically is constructed of a coated nylon material which is resistant to tears and can be sealed by high-frequency welding common in the life jacket industry. The inflatable bladder 24 is an integral construction comprised of a right chest section 84, and left chest section 86 and a loop neck section 88. The bladder 24 is designed to expand upon receiving a supply of gas or air.

As seen from the front portion 12 in FIG. 4, the right chest section 84 and the left chest section 86 are shown in dotted lines and in a folded condition, The right chest section 84 of the bladder 24 is stored and separately housed in a portion of the compartment defined by the stitching 28, 32, 34, 40 and the portion of the bursting zipper 56 on the right front portion 12 of the vest 10, The right chest section 84 is provided with an adjustment valve 90 (seen in dotted lines) which is in communication with the interior of the bladder 24. The adjustment valve 90 can take many forms and can he variously located on the bladder 24, but in the exemplary embodiment is comprised of a flexible extendable tube 91, the purpose of which will be further described below. The left chest section 84 of the bladder 24 is stored and separately housed in a portion of the compartment defined by the stitching 28, 32, 34, 40 and the portion of the bursting zipper 56 on the left front portion 12 of the vest 10. Lower ends of the right and left chest portions 84, 86, respectively are fixed, such as by stitching bands 92 to the bottom portion Of the first layer 20 which typically allow the lower ends of the right and left. chest portions 84, 86 respectively to extend away from the users body when inflated so as to float the user in a face up position with their mouth out of the water and serve to connect the bladder to the adjustable strap assembly 76 secured around the user's waste.

An opening 94 is formed through the second layer 22 on the left front portion 12 of the vest 10 to permit passage therethrough of a rip cord 96 and a handle 98 attached at an outer end of the rip cord 96. The handle 98 is designed to be externally accessible from the left front portion 12 of the vest 10. The rip cord 96 extends upwardly through the compartment on the left front chest portion 12 and the left shoulder portion 14. An additional layer is sewn over the opening 94 where the rip cord exits through the second layer 22 and is sewn on three sides to the second layer 22 to form a pocket 124 to cover the rip cord 96 and rip cord handle 98 so as to prevent accidental inflation. The bottom edge 126 of the pocket 124 is not sewn to the second layer 22 so as to allow the rip cord 96 to exit the pocket 124 and be easily pulled by the user.

As further seen from the back portion 18 in FIG. 5, the rip cord 96 has a looped form with both portions passing through a hole 100 formed in a mounting plate 102. The mounting plate 102 is secured such as by an upper portion 104 of the band 66 of the first layer 20 adjacent the neck portion 16. An inner end of the rip cord 96 is attached to an actuator of an inflator mechanism or valve 106 which is positioned adjacent an inner surface of the mounting plate 102. The inflator mechanism 106 is connected via a manifold 108 which extends through the mounting plate 102 and into the loop section 88 of the bladder 24 that is stored and housed in a folded condition in the compartment between the first layer 20 and the second layer 22 as defined by the bursting zipper 56 on the back portion 18. An upper portion of the loop section 88 is secured adjacent the neck portion 16 such as by stitching 110, but may be otherwise secured to the vest as desired. A bottom end of the inflator mechanism 106 is connected in communication with a disposable gas canister 112 which typically holds a charge of $CO_2$ gas.

Figure 6:
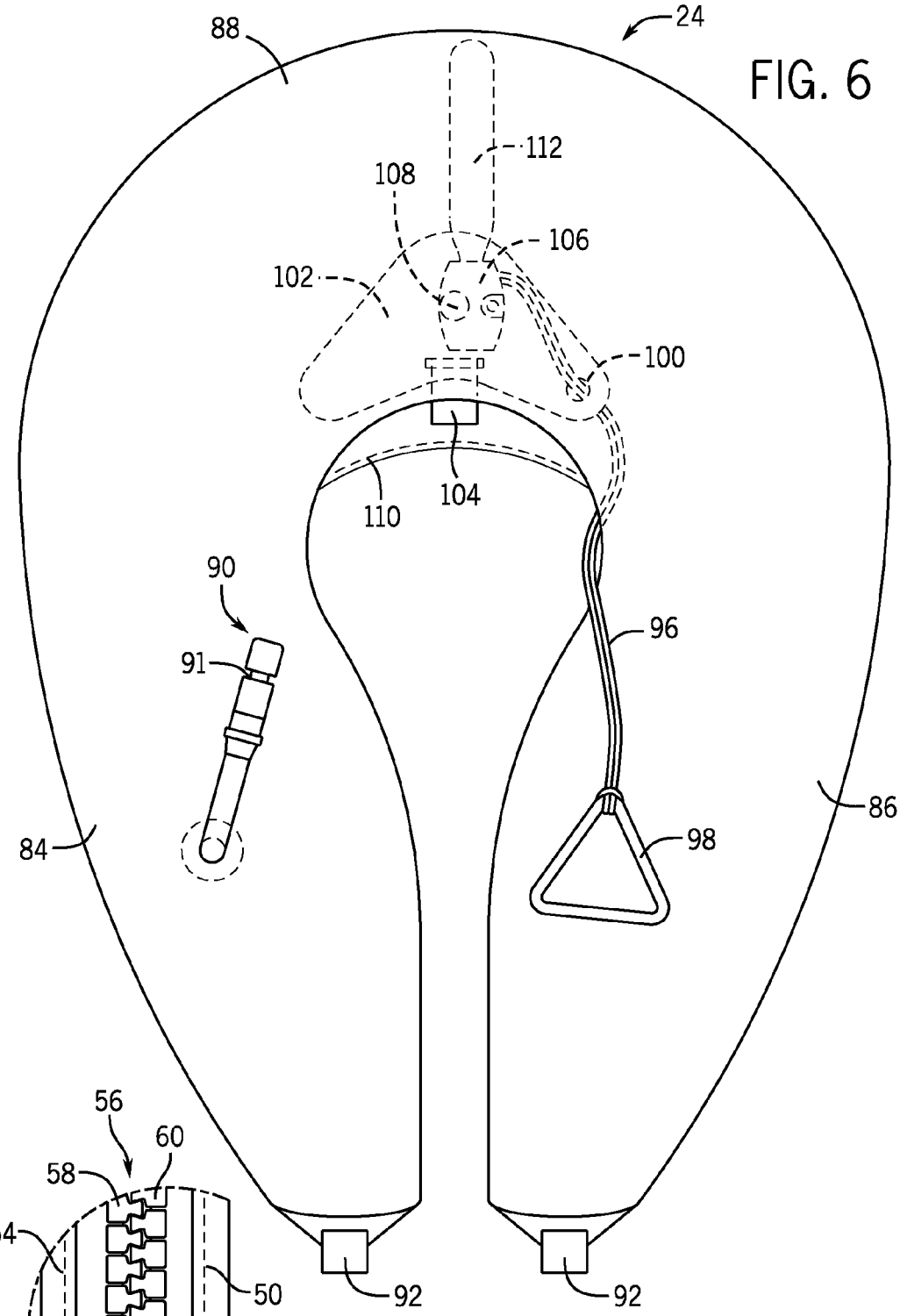
FIG. 6 is an enlarged front view of the inflatable bladder removed from the swim vest, and shown in an inflated condition.
Figure 9:
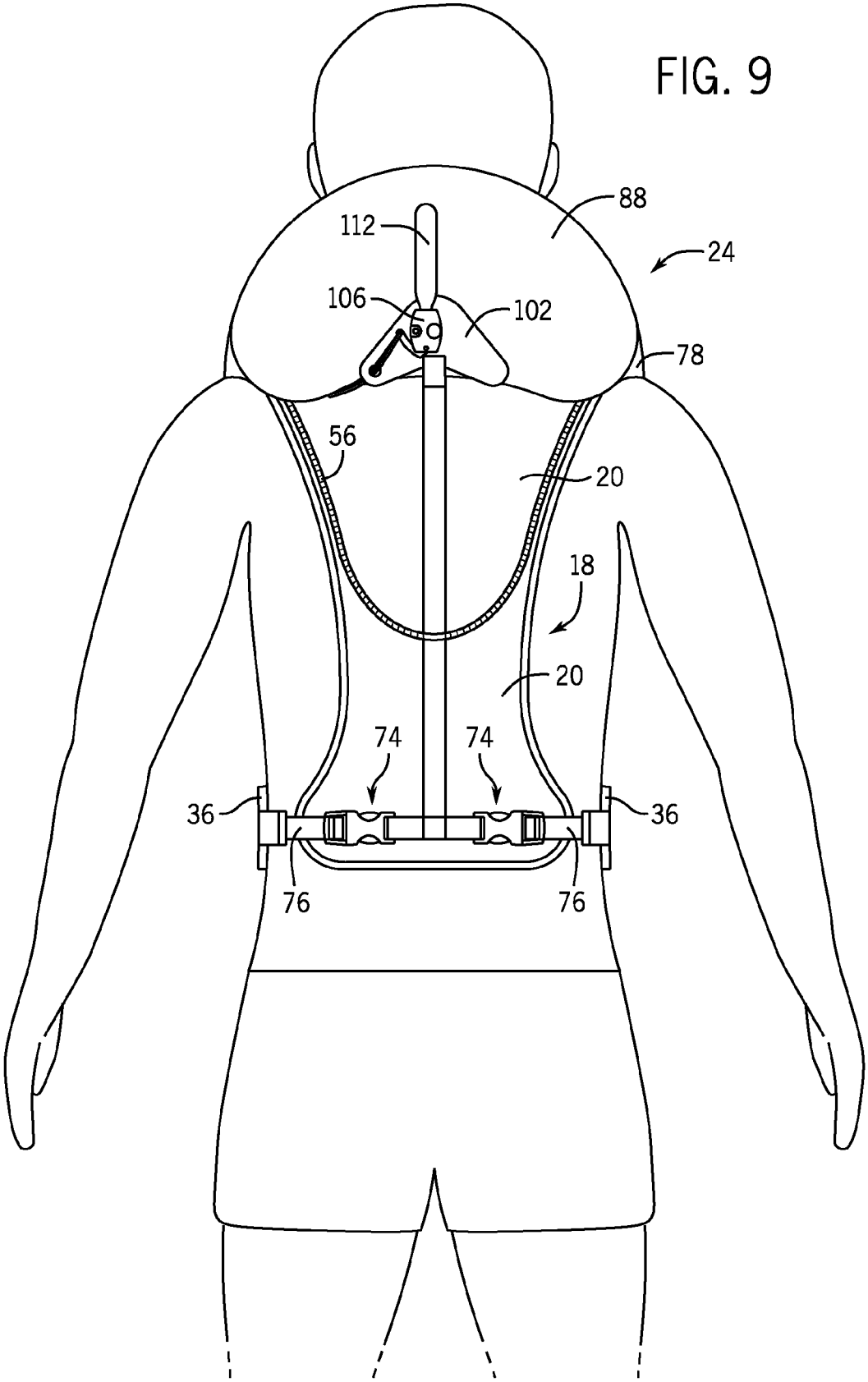
FIG. 9 is a rear view of FIG. 8.

When a user wearing the vest 10 finds himself or herself in an emergency situation while swimming, they grasp the handle 98 and pull the rip cord 96 which triggers the inflator mechanism 106 to dispel the contents of the gas canister 112 into the inflatable bladder 24. As the bladder 24 inflates, it forces open the bursting zipper 56 or other temporary closure such as on flap portion 78 attaching the first layer 20 and the second layer 22, and extends outside the compartment formed by these layers as depicted in FIGS. 6 and 9.

Figure 10:
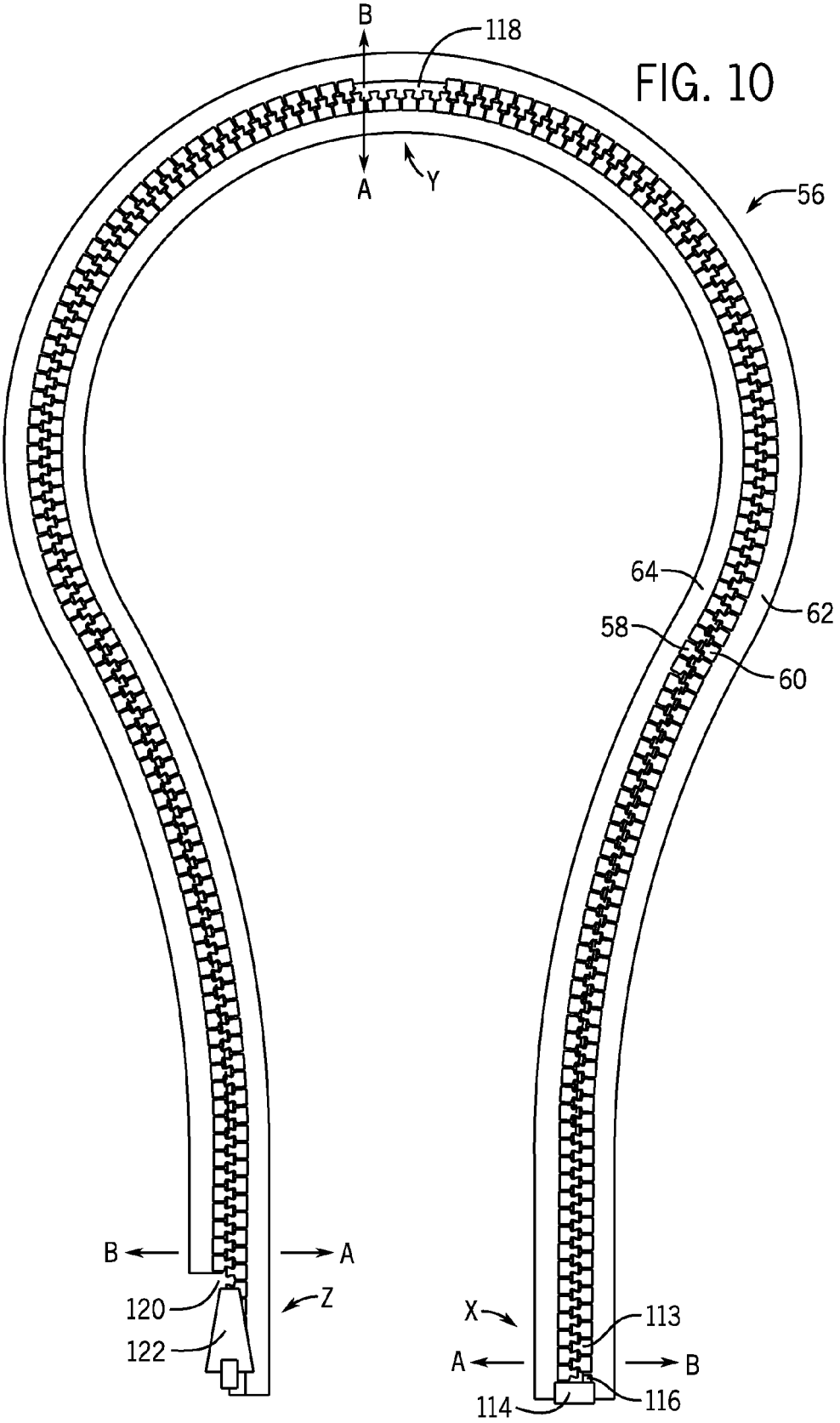
FIG. 10 depicts the bursting zipper with multiple weak points and illustrates the function of these weak points.

FIG. 10 is a view of only the bursting zipper 56, as separated from the swim vest for the ease of understanding. The bursting zipper 56 is designed in such a way as to have a plurality of weakened areas to facilitate separation of the zipper 56. In the embodiment shown, the zipper 56 includes three points where, when the bladder 24 inflates, the inflation force and increasing bladder size cause the zipper sides 58,60 to easily separate in opposite directions. In FIGS. 10 and 11, these weakened area are shown at three distinct points X, Y, and Z. As shown in FIG. 11, the proximal end 113 of the bursting zipper 56 includes the zipper box 114. Unlike typical zippers where the zipper box has walls to lock the zipper pin 116 in place and prevent the zipper from separating, the side 115 of the zipper box 114 is open and does not have the walls to hold the pin 116 in place. The removal of the zipper box walls allows the zipper to separate when pressure is exerted at this point. The opening on the side 115 of the zipper box 114 allows the pin 116 on zipper side 60 to break away from zipper side 58 laterally out of the side of the box and move in opposite directions A and B. This location is indicated by X on FIG. 4 and FIG. 10.

Referring now to FIG. 12, the midpoint of the zipper has a gap 118 of approximately one inch created by the removal of the zipper teeth from the outer zipper side 60. The removed zipper teeth create the gap 118 where zipper sides 58 and 60 do not interlock. The gap 118 creates the second weakened point Y in this exemplary embodiment wherein pressure from the expanding bladder separates in direction A and B opening the zipper as illustrated by FIG. 12. As shown in FIG. 5, the hook and loop 82 keeps this non-interlocking, weak point from separating when the bladder 24 is not inflated. The gap 118 can take the form of an area where teeth are removed from one or both sides of the zipper, or an area where the teeth are modified on one or both sides of the zipper so that they do not interlock.

Figure 8:
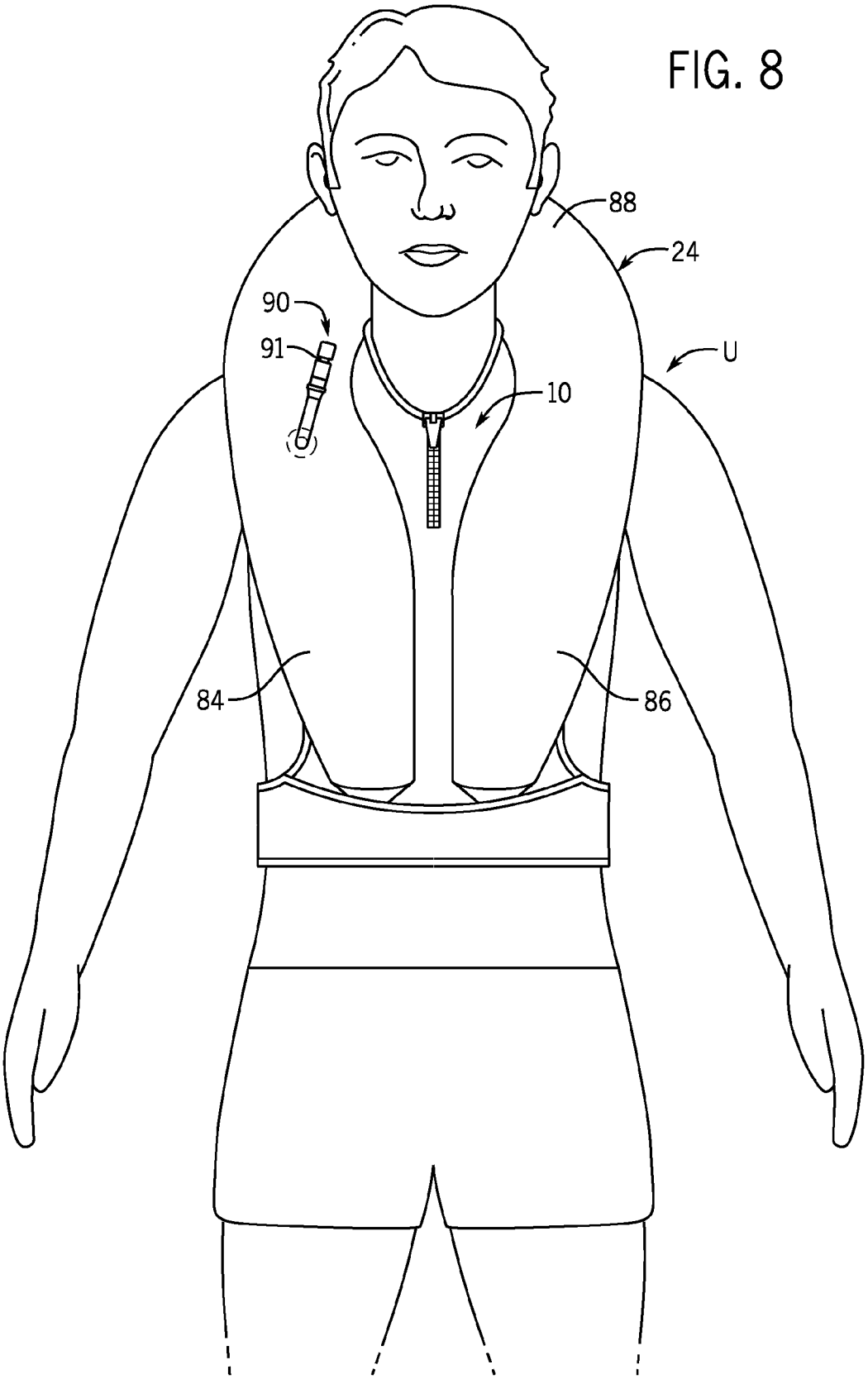
FIG. 8 is a view similar to FIG. 2 showing the swim vest with the bladder in an inflated condition.

The third weakened point is formed at the distal end of the zipper at location Z on FIGS. 4 and 10. In the embodiment shown more clearly in FIG. 13, zipper side 58 is longer than the zipper side 60 by the extended length 120. The different lengths of the zipper sides 58 and 60 allow the zipper pull 122 to nm off the end of zipper side 60. When the bladder 74 inflates the shorter zipper side 60 is allowed to move laterally from zipper side 58, thereby opening this section of the zipper 56 in directions A and B illustrated by FIG. 13. All three of the weakened points of the zipper 56 in this exemplary embodiment open simultaneously upon inflation of the bladder 24, thereby disengaging the entire zipper 56 and separating zipper sides 58 and 60 allowing for complete bladder 24 expansion as depicted in FIGS. 8 and 9. When inflated, the right and left chest sections 84, 86 extend downwardly over the user's chest and the loop section 88 extends upwardly around the rear of the user's neck. The vest 10 then immediately brings the user U to the water surface and out of harm's way, while keeping the user face up with their head above water.

FIG. 6 illustrates the inflated bladder 24 and associated operating components therefor removed from the vest 10 and shows the relative positions of the adjustment valve 90, the rip cord 96, the handle 98, the mounting plate 102, the inflator mechanism 106, the manifold 108 and the gas canister 112 after the vest 10 is deployed in the emergency situation. The adjustment valve 90 is designed so that a user U can blow into the tube 91 to further orally inflate the bladder 24 or open the tube 91 to deflate the bladder 24.

Although not shown, the vest 10 contemplates the provision of an additional handle or loop permanently attached to the first layer 20 in the back portion 18 in the center beneath the bladder 24. Such handle or loop when uncovered after inflation could be used by a rescuer to drag the rescued person backwards in the water to safety. This handle would be located high in the center of the back portion 18 so that it would be easy to drag the victim backwards while ensuring that their head and mouth remain above the waterline. The vest 10 further contemplates the use of an automatic inflator mechanism (in place of the manually actuated inflator mechanism 106) which would cause automatic inflation of the bladder 24 upon submersion of the inflator mechanism in the water.

The vest 10 is designed to be reusable such that after the bladder 24 is inflated and the user has made it to safety, the bladder 24 can be deflated using the adjustment valve 90. A user U can then rearm the inflator mechanism 106 with a replacement gas canister 112, fold the bladder 24, store the folded bladder 24 in the compartment formed between the layers 20, 22 in the front and back portions 12, 18 and reattach the bursting zipper 56 along the outer edges 48, 52 to secure the bladder 24 inside the vest 10.

The present disclosure thus provides an over-the-head inflatable swim vest which can be used by water sports enthusiasts or triathletes while swimming with little to no inherent bulk and no inherent buoyancy, but can offer instantaneous buoyancy in emergency situations. In an exemplary embodiment, the swim vest is configured with a sleek contoured construction provided with inwardly curved outer edges on front and back bib-like portions that extend over a user's shoulders and partially down the user's chest and back. The front and back portions are connected under the arms of the user, and around the torso of the user using an adjustable strap arrangement which will provide a snug fit for different body shapes and sizes. The swim vest is designed to be as unobtrusive to a user's swimming activities as possible by providing flexibility and maximum shoulder, back, arm and torso clearance with an ergonomic fit minimizing drag.

The swim vest includes an inflatable bladder having sections with a loop around the neck and extends down both sides of the chest. The bladder sections are stored in a folded condition and separately housed in between two layers of material which are permanently fixed around the collar and temporarily fixed along the outer edge to allow for efficient external expansion during inflation of the bladder. Preferably, the temporary fixing is provided by an easily separable closure in the form of a bursting zipper which promotes an efficient expansion of the bladder.

The swim vest of the present disclosure is designed to be worn by itself directly on the user's body, or over wetsuits so that individuals do not have to purchase specialty wetsuits to gain security of emergency buoyancy. The swim vest can be worn comfortably on warm days or other occasions where an individual would prefer not to wear a wetsuit. Unlike known inflatable vests, the swim vest of the present disclosure is meant to provide the public with a streamlined device which is made to be worn while swimming, and is constructed with a bladder which is easily inflated, deflated, refolded and reused.

Various alternatives and embodiments are contemplated as being within the scope of the following claims, particularly pointing out and distinctly claiming the subject matter regarded as the invention.

What is claimed is:

1. An inflatable personal flotation device comprising:

a vest having at least a front portion connected to a back portion, the front and back portions being adapted to be secured around a torso of a user, the vest being constructed with a first layer and a second layer having respective outer edges secured to each other by a temporary closure to define a compartment between the first layer and the second layer; and an inflatable bladder arrangement including an inflatable bladder stored and housed in a deflated condition in the compartment formed between the first layer and the second layer, the inflatable bladder arrangement further including an inflator mechanism operatively connected to a charged gas canister and to the inflatable bladder, wherein the temporary closure securing the outer edges of the first layer and the second layer together to form the compartment for housing the inflatable bladder therein is configured for temporarily affixing the outer edges together and to be easily separable such that upon actuation of the inflator mechanism, gas is delivered to the inflatable bladder resulting in an inflated condition of the bladder and producing a force that will open the temporary closure and enable expansion of the inflatable bladder out of the compartment in the front and back portions of the vest.

2. The inflatable personal flotation device of claim 1, wherein the temporary closure is a bursting zipper.

3. The inflatable personal flotation device of claim 2, wherein the bursting zipper includes a first zipper side that mates with a second zipper side, further comprising a plurality of weakened points between the first and second zipper sides.

4. The inflatable personal flotation device of claim 3, wherein each of the first and second zipper sides includes a plurality of zipper teeth that mate with each other, wherein one of the first and second zipper sides includes a gap where the zipper teeth do not interlock to define one of the plurality of weakened points.

5. The inflatable personal flotation device of claim 3 wherein each of the first and second zipper sides has a length extending between a distal end and a proximal end, wherein the length of the first zipper side is greater than the length of the second zipper side such that the distal end of the first zipper side extends past the distal end of the second zipper side to define one of the plurality of weakened points.

6. The inflatable personal flotation device of claim 3 wherein each of the first and second zipper sides extend between a distal end and a proximal end, wherein the proximal end of the first zipper side includes a zipper box that receives a zipper pin formed on the proximal end of the second zipper side, wherein the box includes an open side to allow lateral removal of the zipper pin from the zipper box to define one of the plurality of weakened points.

7. The inflatable personal flotation device of claim 1, wherein the inflatable bladder arrangement includes an adjustment valve for enabling deflation and oral inflation of the inflatable bladder in the inflated condition.

8. The inflatable personal flotation device of claim 1, where the inflator mechanism has a tubular connector that extends through a mounting plate located in the compartment and is connected in the hack portion of the vest.

9. The inflatable personal flotation device of claim 1, wherein the inflatable bladder is attached to an upper end of the back portion and chest sections which are attached to a lower end of the front portion.

10. The inflatable personal flotation device of claim 1, wherein a rip cord has one end attached to the inflator mechanism, and another end which is provided with a handle and extends through an opening formed in the front portion.

11. An inflatable personal flotation device comprising:

a vest having a front portion, a back portion, shoulder portions connected to the front and back portions and an open neck portion located between the front, back and shoulder portions, the vest being constructed with a first layer adapted to rest against a user's skin, and a second layer facing outwardly from the first layer, the first layer and the second layer having respective outer edges secured together by a temporary closure to define a compartment between the first layer and the second layer, the vest being provided with a strap arrangement connected to at least one of the front and back portions and adapted to be secured around a user's torso; and an inflatable bladder arrangement including an inflatable bladder formed with a pair of chest sections connected together by a looped neck section, the chest sections and the looped neck section being stored and housed in a folded and deflated condition in the compartment formed between the first and second layers, the inflatable bladder arrangement further including an inflator mechanism operatively connected to a charged gas canister and to the inflatable bladder and located in the compartment in the back portion of the vest, and an adjustment valve connected to the inflatable bladder and positioned in the compartment in the front portion of the vest, wherein the temporary closure securing the outer edges of the first layer and the second layer together to form the compartment for housing the inflatable bladder therein is configured for temporarily fixing the outer edges together and to be easily separable such that upon actuation of the inflator mechanism, gas is delivered to the inflatable bladder from the gas canister resulting in an inflated condition of the bladder and producing a force that will open the temporary closure and enable expansion of the bladder out of the compartment formed in the front and back portions of the vest.

12. The inflatable personal flotation device of claim 11, wherein the temporary closure and the stitching define the separate areas of the compartment for storing the chest and looped neck sections of the inflatable bladder.

13. the inflatable personal flotation device of claim 11, wherein the temporary closure is a bursting zipper.

14. The inflatable personal flotation device of claim 11, wherein the outer edges of the first layer and the second layer run continuously along the front portion, the shoulder portions and the back portion.

15. The inflatable personal flotation device of claim 11, wherein the second layer is formed as a flap portion in the back portion of the vest.

16. The inflatable personal flotation device of claim 13, wherein the bursting zipper includes a first zipper side that mates with a second zipper side, further comprising a plurality of weakened points between the first and second zipper sides.

17. The inflatable personal flotation device of claim 16, wherein each of the first and second zipper sides includes a plurality of zipper teeth that mate with each other, wherein one of the first and second zipper sides includes a gap where the zipper teeth do not interlock to define one of the plurality of weakened points.

18. The inflatable personal flotation device of claim 16 wherein each of the first and second zipper sides has a length extending between a distal end and a proximal end, wherein the length of the first zipper side is greater than the length of the second zipper side such that the distal end of the first zipper side extends past the distal end of the second zipper side to define one of the plurality of weakened points.

19. The inflatable personal flotation device of claim 16 wherein each of the first and second zipper sides extend between a distal end and a proximal end, wherein the proximal end of the first zipper side includes a zipper box that receives a zipper pin formed on the proximal end of the second zipper side, wherein the box includes an open side to allow lateral removal of the zipper pin from the zipper box to define one of the plurality of weakened points.

20. The inflatable personal flotation device of claim 11, wherein a rip cord has one end attached to the inflator mechanism, and another end which is provided with a handle and extends through an opening formed in the front portion.

* * * * *